US008371607B2

(12) United States Patent
Lopez

(10) Patent No.: US 8,371,607 B2
(45) Date of Patent: Feb. 12, 2013

(54) TRANSPORTABLE COLLAPSIBLE SHADE STRUCTURE

(75) Inventor: Jose Antonio Lopez, Holtville, CA (US)

(73) Assignee: Jose Antonio Lopez, Holtville, CA (US)

( * ) Notice: Subject to any disclaimer, the term of this patent is extended or adjusted under 35 U.S.C. 154(b) by 158 days.

(21) Appl. No.: 12/566,597

(22) Filed: Sep. 24, 2009

(65) Prior Publication Data

US 2012/0068505 A1 Mar. 22, 2012

Related U.S. Application Data

(60) Provisional application No. 61/099,862, filed on Sep. 24, 2008.

(51) Int. Cl.
*B62B 3/02* (2006.01)

(52) U.S. Cl. ..... 280/656; 135/88.1

(58) Field of Classification Search ..... 280/656; 135/88.1, 88.11, 88.12
See application file for complete search history.

(56) References Cited

U.S. PATENT DOCUMENTS

| | | | | |
|---|---|---|---|---|
| 4,232,488 | A * | 11/1980 | Hanley | 52/7 |
| 4,660,332 | A * | 4/1987 | Colvin, Jr. | 52/79.5 |
| 5,152,109 | A * | 10/1992 | Boers | 52/143 |
| 5,462,330 | A * | 10/1995 | Brown | 296/172 |
| 6,068,008 | A * | 5/2000 | Caldwell | 135/99 |
| 6,739,617 | B1 * | 5/2004 | Martin | 280/656 |
| 6,750,829 | B2 * | 6/2004 | Luoma et al. | 345/1.1 |
| 6,923,498 | B1 * | 8/2005 | Mecham | 296/210 |
| 7,165,779 | B2 * | 1/2007 | Badger et al. | 280/656 |
| 7,178,857 | B2 * | 2/2007 | Williams | 296/173 |
| 7,201,431 | B1 * | 4/2007 | Calandruccio | 296/173 |
| 7,357,440 | B1 * | 4/2008 | Calandruccio | 296/156 |
| 7,681,941 | B2 * | 3/2010 | Freeman et al. | 296/168 |
| 7,819,128 | B2 * | 10/2010 | Clark et al. | 135/88.08 |
| 7,828,316 | B1 * | 11/2010 | Joseph | 280/414.1 |
| 7,967,369 | B2 * | 6/2011 | Davidson | 296/173 |

* cited by examiner

*Primary Examiner* — Jeffrey J Restifo
(74) *Attorney, Agent, or Firm* — Albert Ubieta; Torrey Pines Intelectual Property Group, P.C.

(57) ABSTRACT

A transportable shade device to provide a portable shaded area for outdoor workers. The structure features a wheeled frame which is engageable to be towed. A pair of opposing shade panels are rotationally engaged to a vertical support above a center section of said frame. Both panels rotate to an extended position to maximize shade to a seating area on the frame and rotate to a retracted position to minimize wind load on the structure during towing at highway speeds.

17 Claims, 3 Drawing Sheets

TRANSPORTABLE COLLAPSIBLE SHADE STRUCTURE

This application claims priority from U.S. Provisional Application No. 61/099,862 filed on Sep. 24, 2008 which is incorporated herein in its entirety by reference.

BACKGROUND OF THE INVENTION

1. Field of the Invention

The disclosed device relates to a portable shade for providing shaded relief for workers operating in a high sun environment. More particularly, the disclosure relates to a portable shade structure adapted for towing and having an overhead shade which collapses for transport yet increases in size during use. Seating optimized for users to drink and enjoy shaded seats is positioned under the shade surrounding a drink dispenser.

2. Prior Art

Workers operating in a high sunlight environment are under constant threat of over exposure to the sun and of a potential heat stroke from such exposure. This is especially true of farm workers who frequently toil in areas of the country which are very sunny since those areas are generally some of the best places to grow crops which the field workers pick and tend.

Recently, some states in the United States have begun to examine the working conditions for such workers who toil long hours in the hot sun during any given day. A chief concern which has arisen is the availability of a shaded area for those workers to seek refuge from the continual sunlight and to rest in a cooler shaded environment. Many states are now requiring that shaded areas be provided for meals, breaks, and restroom facilities for outdoor workers.

This requirement to provide shade to workers in fields of crops presents a problem in most growing environments where crops are grown which require workers for field hand picking and tending. Shade is generally not readily available since maximizing crop yield dictates that shaded areas, generally provided by trees or structures, be avoided, since crops generally do not grow as well, or as fast in shaded areas. Further, shaded areas in a field require a support structure or a large tree for instance, both of which become impediments to the use of farm machinery to plow and tend the fields.

With upcoming regulations sure to require shaded areas in more states and for all workers in a commercial growing environment using farm workers. Growers will be presented with a major problem due to the current lack of such shaded areas either provided by nature, or because of prior requirements to keep the fields clear for large equipment. Consequently, many commercial growers will be hard pressed to provide the newly required shaded areas to all workers, yet make sure that the shade being provided does not impede farm equipment, and that the shade provided is proximate at all times to the workers seeking it. Proximity is a problem due to the very size of growing areas where workers toil which can be miles across.

As such, there is an unmet need for a device and method for providing shaded areas to workers toiling in the sun in a farming environment. Such a device should be easily positioned proximately to the workers needing it in the acres of growing areas to avoid long walks to seek shade. Such a device should be easily transportable in order to be placed proximate to the workers over the course of a day, week, or month as they traverse to different parts of the fields which may be miles apart. Further, such a device should be removable so as not to be an impediment to large field equipment, and yet be sufficiently stable during such movement so as not to become airborne or tip from the wind load upon the overhead shade structure. Finally, such a device should be adapted in construction to provide sufficient seating for as many workers as possible yet concurrently provide those seated workers with a source of water or liquid while seated or under the shade which may be reached from just about any seat provided. The device herein described is directed toward meeting those needs.

SUMMARY OF THE INVENTION

The invention herein described and depicted, provides a mobile, easily transportable, lightweight shade structure. The structure is adapted to allow a plurality of workers refuge from the sun or rain while tending or picking crops in the sun in agricultural fields.

The device features a frame portion adapted at a front end for engagement to a towing hitch to allow it to be easily transported over highways or fields. This frame structure employs two wheels to support the frame elevated above the support surface to provide elevated seats and to provide a means to roll the structure when towed.

A shade support structure is engaged to the wheeled support frame. The shade support structure features upright members engaged in a substantially vertical position to a horizontally positionable shade frame. At the top end of the uprights is engaged a pair of shade panels. The shade panels so positioned have an elevated position extended to provide a maximum area of shade underneath. The shade panels also have a collapsed position to allow for towing of the device at higher speeds to other areas of the working field, without imparting excess wind load which could damage the structure and affect the stability of the device during movement.

The shade panels, rotated to their elevated position, extend outwardly from a central portion of the support frame member atop the upright members. These shade panels are rotationally engaged at one end to their engagement point to the uprights and cross member positioned above a central portion of the lower support frame. A proximate or inside edge of each such shade panel is rotationally engaged to the uprights or cross member between them. Raising and lowering the shade panels can be manually done by lifting the outer edges and inserting an angled support member to hold them elevated. Alternatively, mechanical means such as gears and handles engaged to the frames may be employed to raise and lower them.

In a preferred mode to keep the device lightweight, the shade panels are formed of a perimeter shade frame of metal and an interior portion of shade cloth engaged to the shade frame with ties or rope. Shade cloth is very light weight and still provides excellent shade underneath for workers. A white shade cloth, in a weave or knit is especially preferred since white will reflect UV and other harmful sunlight spectrums, and a weave or knit will allow hot air to pass through the shades in the elevated position rather than collect underneath as would occur with solid shade material. A reasonably tight weave will still allow hot air to escape from under the shades but keep rain from hitting underneath.

Seating is engaged to the support frame along the center axis extending between the wheels and positioned perpendicular to it to provide maximum area for users underneath.

Especially preferred, on a centrally located upright, a fluid container for water or the like is located. It has been found through experimentation that centrally locating the fluid container on the centrally located support frame will allow the most user seating on the seats provided and easy means to access the water or fluid by simply reaching up to dispense water or drinks.

It is therefor an object of this invention to provide a transportable shade structure capable of both high speed highway and off road towing to new venues to follow users.

It is an additional object to provide such a structure with a folding shade section to minimize wind load when being towed at higher speeds and to allow it to be opened and towed at lower speeds for repositioning in the field while carrying workers if desired.

These together with other objects and advantages which become subsequently apparent reside in the details of the construction and operation of the portable shade structure as more fully hereinafter described and claimed, reference being had to the accompanying drawings forming a part thereof, wherein like numerals refer to like parts throughout.

BRIEF DESCRIPTION OF DRAWING FIGURES

DETAILED DESCRIPTION OF THE PREFERRED EMBODIMENTS OF THE INVENTION

Figure 1:
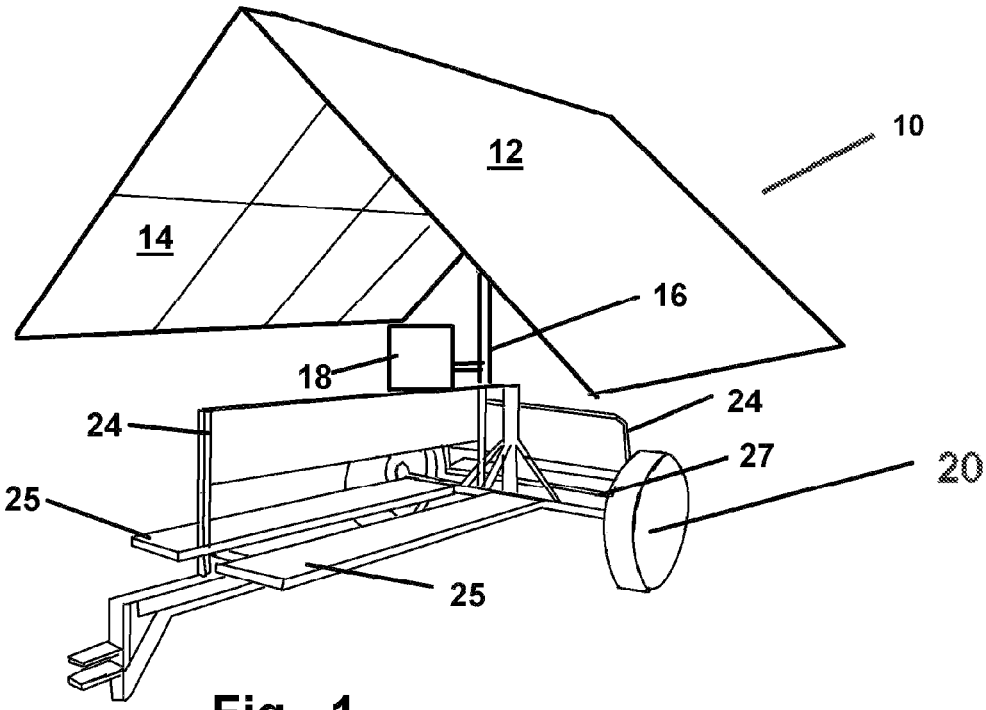
FIG. 1 is a perspective view of the shade structure with shade panels in a transitional position angled upward between an extended position and a collapsed position.

Referring now to the drawings, the device 10 is shown in FIGS. 1-6 wherein similar parts are identified by like reference numerals.

In the perspective view of FIG. 1 the shade structure device 10 is shown stored, with the two rotationally engaged shade panels 12 and 14. As shown the shade panels 12 and 14 have been rotated to a extended position as in FIG. 4-5 and collapsed as in FIGS. 2-3. The panels are rotationally engaged to be supported by uprights 16. The uprights 16 are centrally located and also provide support for elevated support of the fluid container 18. Wheels 20 provide rolling support when the trailer hitch 22 is engaged and the device 10 is towed.

Figure 2:
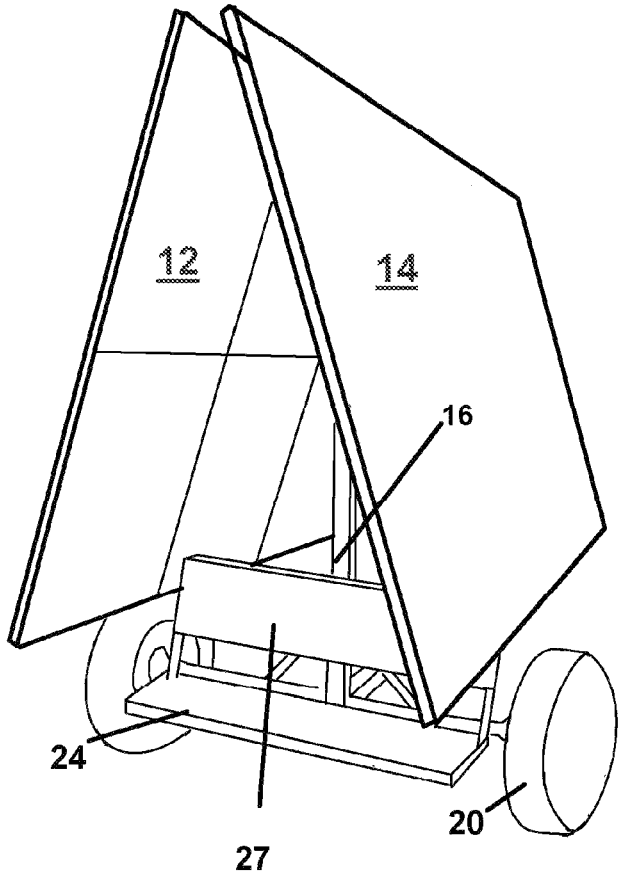
FIG. 2 shows the device of FIG. 1 with the shade panels in the collapsed position and the center uprights to support the panels and fluid container.
Figure 3:
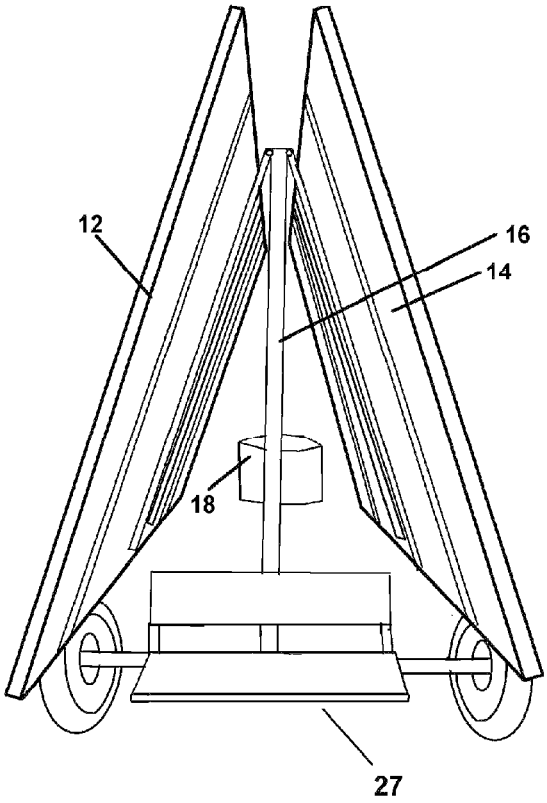
FIG. 3 is a perspective view of the device of FIG. 2 with a bench seat perpendicular to the center axis of the support frame and the shade panels collapsed.

When towed at higher speeds the device 10 would be moved to the collapsed position of FIGS. 2-3. This minimizes wind load and wind lift to the device, especially at highway speeds.

Figure 4:
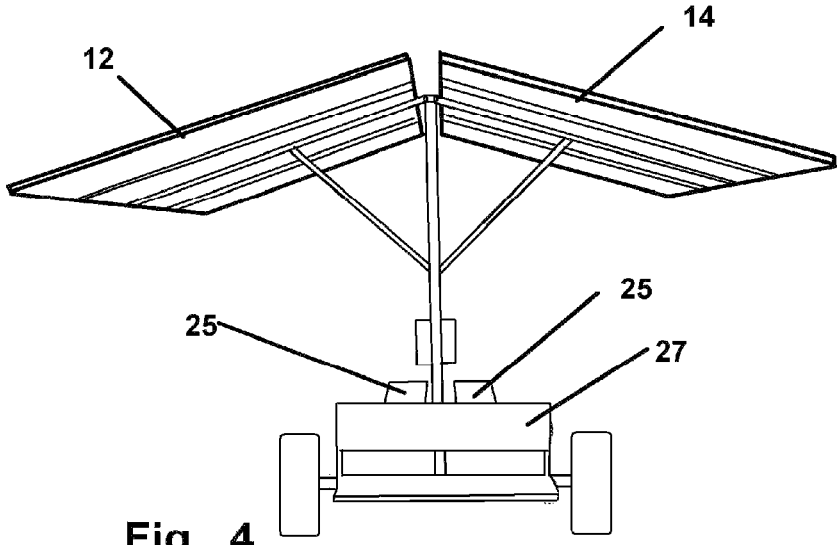
FIG. 4 shows the device from a rear view in an engagement adapted for towing with the shade panels extended.
Figure 5:
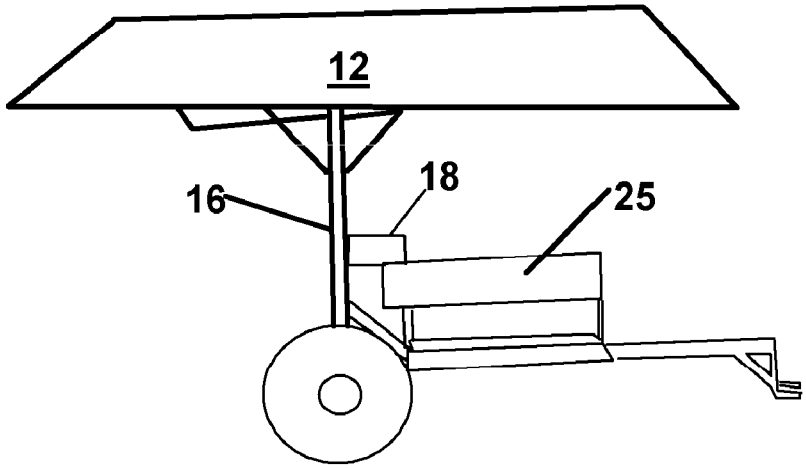
FIG. 5 depicts a side view of the device with the shade panels extended as in FIG. 4.
Figure 6:
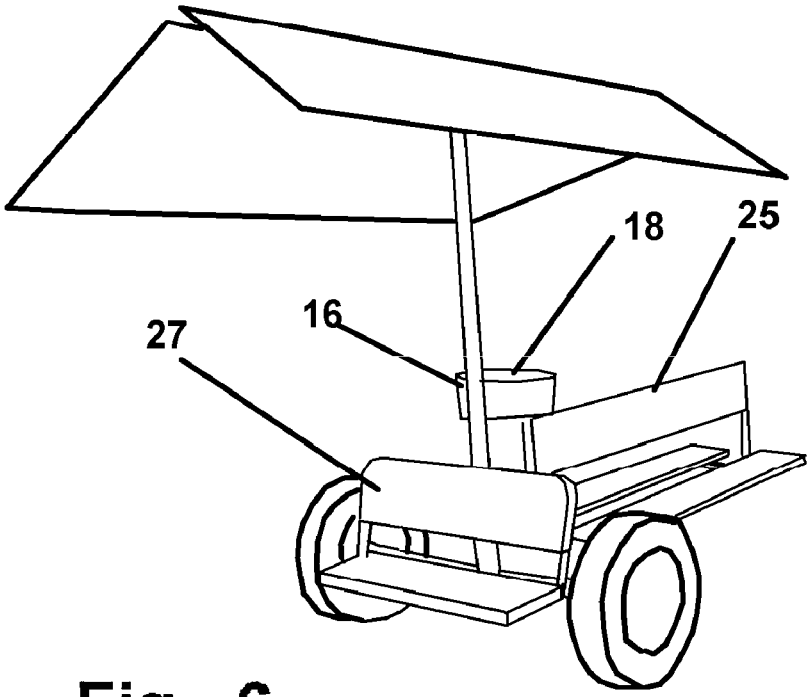
FIG. 6 shows a perspective view of the device in a typical towed position during slow off road towing speeds where the shade panels may remain extended allowing worker transport in the shade.

As shown in FIGS. 4-6, seating area 24 is provided in two rows perpendicular to each other and purposely surrounds the centrally located fluid container 18. The shade panels 12 and 14 have been rotated to the extended position in FIGS. 4-6 typical of stationary positioning of the device or low speed transport.

A first seating area 25 is provided up the middle of the device 10 where the most shadow will develop when it is in the extended position with the shade panels 12 and 14 rotated substantially horizontal. A second seating area 27 is provided perpendicular to the first seating area 25 which bisects the middle of the second seating area 27. By placing the seating 24 up the midline of the device 10 parallel to the center line between the shade panels 12 and 14, and also perpendicular to the center line, virtually all seating 24 under the shade panels 12 and 14 is placed in reach of the water or fluid container 18 and access to fluids is maximized. Because almost all users occupying the seating 24 can reach the fluid supply 18 the device may also be employed as an open air off road transport wherein workers sitting on seating 24 can relax while being driven to another portion of the field workplace and can concurrently reach the fluid supply 18 without having to stand which would be precluded when moving.

While all of the fundamental characteristics and features of the transportable collapsible shade system and method have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A transportable shade apparatus comprising:

a frame, said frame connected to a pair of opposing wheels, said frame further adapted to permit engagement to a towing hitch;

at least one vertical support engaged to said frame extending from a connection with said frame to a distal end of said vertical support;

at least two shade panels, each said shade panel having a first edge and second edge opposite said first edge;

said first edge of each said shade panel in a rotational connection adjacent to said distal end of said vertical support;

said shade panels having a rigid frame around a perimeter edge and an interior portion inside said perimeter edge;

said interior portion each of said shade panel having shade material connected therein;

said shade panels having a collapsed position at an angle downward toward said wheels wherein said second edge of each is positioned adjacent to said wheels;

said shade panels having an extended position extending substantially horizontally from said first edge to said second edge thereby producing a shaded area thereunder;

a support member adapted to maintain the selected position of said shade panels; and at least one seating area positioned upon said frame, said seating area positioned to be within said shaded area.

2. The transportable shade apparatus of claim 1, additionally comprising:

said seating area disposed proximate to, and parallel with, a longitudinal center axis of said frame.

3. The transportable shade apparatus of claim 2, additionally comprising:

a second seating area positioned (i) rearwardly from said first seating area and (ii) adjacent to one vertical support;

wherein said vertical support is adapted to provide elevated support for a fluid container.

4. The transportable shade apparatus of claim 3, additionally comprising:

said shade material being fabric, further comprising air passages therein between threads of said shade fabric.

5. The transportable shade apparatus of claim 4, additionally comprising:

said shade panels configured such that, in said collapsed position, said second edge is located inwardly of said wheels.

6. The transportable shade apparatus of claim 5, wherein said at least one vertical support comprises a single vertical support.

7. The transportable shade apparatus of claim 6, wherein said second seating area is positioned perpendicular to said first seating area.

8. The transportable shade apparatus of claim 6, wherein said second seating area is positioned parallel to said first seating area.

9. The transportable shade apparatus of claim 3, wherein said second seating area is positioned parallel to said first seating area.

10. The transportable shade apparatus of claim 3, wherein said second seating area is positioned perpendicular to said first seating area.

11. The transportable shade apparatus of claim 2, wherein said at least one vertical support comprises a single vertical support.

12. The transportable shade apparatus of claim 2, additionally comprising:

said shade panels configured such that, in said collapsed position, said second edge is located inwardly of said wheels.

13. The transportable shade apparatus of claim 2, additionally comprising:

said shade material being fabric, further comprising air passages therein between threads of said shade fabric.

14. The transportable shade apparatus of claim 13, wherein said fabric shade material is selected from the group consisting of: a weave and a knit.

15. A transportable shade apparatus comprising:

a frame, said frame connected to a pair of opposing wheels, said frame further adapted for engagement to a towing hitch;

two or more vertical supports located substantially above the centerline of said frame, and engaged to said frame extending from a connection with said frame upwardly to a distal end of said vertical support;

a cross member joining the distal ends of each said vertical support;

at least two shade panels, each said shade panel having a first edge proximate to said cross member, and second edge opposite said first edge;

a rotational engagement between said first edge of each said shade panel and said cross member, wherein said rotational engagement is adapted to allow said shade panels to rotate between (i) a collapsed position at an angle downward from said cross member toward said wheels, wherein said second edge of each said shade panel is positioned adjacent to said wheels and (ii) an extended position extending substantially horizontally from said first edge to said second edge;

at least one support member having one end connected to said vertical support and the other end connected to said shade panel, said support member adapted to maintain the selected position of said shade panels;

at least one seating area positioned upon said frame, said seating area positioned proximate to the longitudinal centerline of said frame, said seating area further positioned aft of said adaptation for engagement of a towing hitch and forward of said pair of opposing wheels; and a support for a fluid container on one or more said vertical supports.

16. The transportable shade apparatus of claim 15 further comprising a second seating area positioned aft of said pair of opposing wheels.

17. The transportable shade apparatus of claim 16 wherein said second seating area is positioned parallel to said first seating area.

* * * * *